US005190400A

United States Patent [19]

Sterner

[11] Patent Number: 5,190,400

[45] Date of Patent: Mar. 2, 1993

[54] SCREED SPREADER BOX AND COMPACTION ROLLER

[76] Inventor: Carl L. Sterner, 3860 Nord Rd., Bakersfield, Calif. 93312-9215

[21] Appl. No.: 756,236

[22] Filed: Sep. 9, 1991

Related U.S. Application Data

[63] Continuation-in-part of Ser. No. 446,558, Dec. 5, 1989, Pat. No. 5,046,889.

[51] Int. Cl.[5] ..... E01C 19/28

[52] U.S. Cl. ..... 404/103; 404/105; 404/117; 404/122; 404/132

[58] Field of Search ..... 404/83, 101-103, 404/108, 113, 114, 118; 172/240

[56] References Cited

U.S. PATENT DOCUMENTS 4,124,325 11/1978 Cutler ..... 404/95 X 5,046,889 9/1991 Sterner ..... 404/105 X

*Primary Examiner*—Ramon S. Britts

*Assistant Examiner*—Roger J. Schoeppel

*Attorney, Agent, or Firm*—Ross, Howison, Clapp & Korn

[57] ABSTRACT

A spreading device for applying paving material behind a towing vehicle, has a fixed or extendable frame spreader box, an adjustable screed for screeding or spreading the paving material to a desired depth of spread, an adjustable compression roller for compacting the paving material, sides on the spreader box, adjusters on the screed and the compression roller to adjust the depth of spread of the paving material, and a pressure cylinder attached between the towing vehicle and the spreader box for applying pressure downwardly on the compaction roller while lifting upwardly on the towing vehicle.

16 Claims, 5 Drawing Sheets

SCREED SPREADER BOX AND COMPACTION ROLLER

CROSS REFERENCES TO RELATED APPLICATIONS

This application is a continuation-in-part of patent application Ser. No. 446,558, filed Dec. 5, 1989, now U.S. Pat. No. 5,046,889.

TECHNICAL FIELD OF THE INVENTION

This invention relates to a spreading device or a spreader box for applying, screeding to proper thickness and compacting cold, mixed, emulsified asphaltic concrete paving mixtures and Portland concrete cement on a prepared surface.

BACKGROUND OF THE INVENTION

In 1985, I received a patent for a machine called a "POTHOLE PATCHER" which provided a cold mixed asphaltic concrete paving material, U.S. Pat. No. 4,511,284. This machine mixes, fills and compacts "potholes" with asphaltic concrete paving material. It has a roller on the front end which is lowered to the desired depth of spread and as the machine rolled forward over the patch, it was spread out and smoothed to the desired thickness. After the pass to spread out and smooth the patch, the roller is then lowered further which raised the front end of the machine off the ground and the machine is put in reverse and the front roller then thoroughly compacts the paving mixture as the machine and roller backs over the patch. This machine worked very well for small "potholes" but we wanted to make a larger machine for full width highway paving using the cold mixed process. We found the cold mixed, sticky, asphalt paving material was next to impossible to smooth out and spread in preparation for rolling and compacting in large amounts. We tried many types of conventional asphalt spreading devices, both heated and unheated. None worked very well and most of the time the sticky cold mixed asphalt paving material would build-up in front of the screed and just slide along and not spread out. Cold mixed asphaltic concrete paving material has much the same characteristics as bread dough. Bread dough cannot be spread with a knife or blade, it must be spread and smoothed out with a "rolling pin". After building and trying many types of spreading devices, which did not work well, I finally hit upon the idea of putting an adjustable "rolling screed" in a spreader box followed by a compression roll. This works similar to our "Pothole Patcher" which employed a forward pass as a screed roll and a reverse pass as a compression roll. Additional pressure applied from the mixer vehicle aids complete compaction and reduces or eliminates the need for further final roadway compacting.

My new invention is called the "Rolling Screed" Spreader Box. The "Rolling Screed" Spreader Box does a very smooth job of spreading cold mixed asphaltic concrete paving material and has been improved and adapted also for cement concrete paving material as well.

SUMMARY AND DISCUSSION OF PRIOR ART

Paving devices plate screeds and separate rollers, compactors have been disclosed as in the following patents:

| U.S. Pat. No. | INVENTOR |
|---|---|
| 3,698,393 | Wagner |
| 1,665,054 | Carr |
| 2,025,703 | Bailey |
| 4,219,287 | Marks |
| 4,759,657 | Dorr |
| 3,415,174 | Kaltenegger |
| 4,682,908 | Domenighetti |
| 3,871,788 | Barsey |
| 3,967,912 | Parker |
| 4,011,023 | Cutter |
| 4,547,247 | Sandstrom |
| 4,702,642 | Music |
| 4,717,282 | Anderson |

U.S. Pat. Nos. 3,967,912; 4,011,023; and 4,759,657, show spreading devices which employ an adjustable height spreading "plank" on flat plate screed, but no rolling screed followed by a compression or compaction roll. Further, none of these disclose the application of pressure on a screed and compaction roller unit.

All of the devices in U.S. Pat. Nos. 1,665,054; 2,025,703; 3,415,174; 3,698,293; 3,871,788; 4,219,287; 4,647,247; 4,682,908; 4,702,641; and 4,717,282 are compaction devices and none have an auger for lateral distribution of material or an adjustable, screed roll or an adjustable compression roll. Further, none disclose adjustable hydraulic pressure applied from the mixer vehicle to accomplish compaction through a compression roller.

Asphaltic concrete spreading devices, spreader boxes or spreader machines are well known and in widespread use in the asphaltic concrete paving industry. All spreading machines or devices available today for spreading asphaltic concrete paving materials employ a strike off screed or blade or blade-plate for spreading or smoothing the asphaltic concrete paving mixture. These devices work very well for spreading hot mixed asphaltic concrete or oil cut-back mixtures because these materials slow easily. Cold mix asphaltic paving mixtures made with cold aggregate and cold asphalt emulsions do not flow easily and are very sticky and very hard to spread. Cold mixed asphaltic paving mixtures have characteristics similar to bread dough. You cannot spread and smooth bread dough with a knife blade. It can only be spread and smoothed with a rolling pin. Cold mixed asphaltic paving mixtures are much the same. These mixtures can be readily spread with a "ROLLING SCREED" but are very difficult to spread with conventional spreading devices employing a strike-off blade or blade-plate. The use of these conventional spreading devices for spreading cold mixed asphaltic concrete paving mixtures results in a very course surface with many "rock drags". Sometimes the cold sticky emulsion mixture will build-up in front of the screed and will not go under the screed at all. The "ROLLING SCREED" Spreader Box completely solves this spreading problem and will lay a very smooth surface with absolutely no "rock drags" or build-up in front of the screed. Further, the previous devices were not adapted for roller compaction of either asphaltic concrete or Portland concrete cement with the same machine that screeds the paving material.

SUMMARY OF THE INVENTION

The "ROLLING SCREED" Spreader Box is an improved device and method for spreading, laying and compacting cold mixed asphaltic concrete paving mixtures made with cold aggregate and cold asphalt emulsion as a binder. Alternately, a vibratory plate screed can be used for spreading and laying Portland cement and compacting the cement with compression roller combined in the same unit. Pressure is applied to the compression roller directly from a front wheel drive mixer vehicle.

Cold mixed asphalt paving mixtures made with asphalt emulsion at ambient temperatures and cold aggregate have much the same characteristics as bread dough. You cannot spread bread dough with a knife blade. It must be spread and smoothed with a rolling pin. Cold mixed asphaltic paving material is much the same. It does not spread well with conventional spreading devices which employ a screed blade or plate strike off device.

The "ROLLING SCREED" works well with cold asphaltic concrete mixture because the rolls turns as the cold, sticky asphalt emulsion mixture passes under the "ROLLING SCREED", resulting in a very smooth surface with absolutely no "rock drags". The "ROLLING SCREED" Spreader Box is equipped with two augers, one on each side of the spreader box. Each auger is reversible in either direction so that the paving mixture can be readily moved from one side of the box to the other. The "ROLLING SCREED" is situated in the spreader box, between the auger and compression roller and is adjustable up or down depending on the desired thickness of the "spread".

In back of the "ROLLING SCREED" is a compression roller. As the cold asphalt mixture passes under the screed, it is screeded to the desired thickness and partially compacted. The compression roller then further compacts the paving mixture. The compression force may be applied through pressure cylinders connected from the frame of the mixer to the top of the spreader box and, thereby, to the compression roller. A maximum force can be applied sufficient to raise the rear of the front wheel drive vehicle off the ground. Lesser amounts can be applied by adjusting the pressure in the cylinders as desired.

The "ROLLING SCREED" and compression roller may both be connected with sprockets and chain so that the screed roll and compression roll both turn together, if desired, at the same speed. Both rolls are equipped with a pad for applying a release agent to the roll. The "ROLLING SCREED" Spreader Box has two wheels mounted in the front of the spreader box, one at each front corner to allow for easy travel over the bituminous surface. It can also be equipped with caterpillar tracks as an option. To change thickness of spread, screw adjustments or other adjustment devices at each side and in the center allow for easy adjustment up or down of the auger, the "ROLLING SCREED", and compression roll. The "ROLLING SCREED" Spreader Box can be made with a "telescoping" frame or bridge and "telescoping" rollers to vary the width of the spreader box. The "ROLLING SCREED" Spreader Box can be operated without the compression roll or with the compression roll in the raised position. The paving mixture would then be compacted by conventional means.

No heating of the rock or asphalt binder is required for cold mixed asphaltic concrete paving mixtures. This makes a better and longer lasting pavement because the oils and plasticizers are not burnt up in the heating process. Last year in the United States, approximately 500,000,000 tons of hot mixed asphaltic concrete paving materials were produced. It takes approximately three gallons of fuel oil to heat one tone of hot mixed paving material. Figuring fuel oil at $1.00 per gallon, equals a savings of $1,500,000,000.00 for the construction industry, if all asphaltic paving materials were made with the cold mixed process and spread with the "ROLLING SCREED". Pollution would be greatly reduced by not burning 1,500,000,000 gallons of fuel oil. This would also make our country more energy self-sufficient and reduce our dependence on foreign oil producing nations.

When Portland cement concrete is used, a vibratory plate screed is preferred, followed by a compaction roller, according to the present invention. The addition of the compression force from the pressure cylinders advantageously allows complete compaction of Portland cement concrete. Full hydraulic pressure in the cylinders will force them against a mechanical stop and is sufficient to raise the rear of the front wheel drive towing vehicle off of the ground. Adjustable amounts of pressure may be advantageously used to apply lesser amounts of compaction if desired. Subsequent finishing compaction as by "steam roller" machines is not needed and the energy requirements and manpower for operating such additional finishing equipment is saved.

BRIEF DESCRIPTION OF THE DRAWINGS

These and other objects and advantages will be better understood with reference to the drawings and detailed description of the invention below, in which like numerals represent like elements and in which.

DETAILED DESCRIPTION OF THE INVENTION

Figure 1:
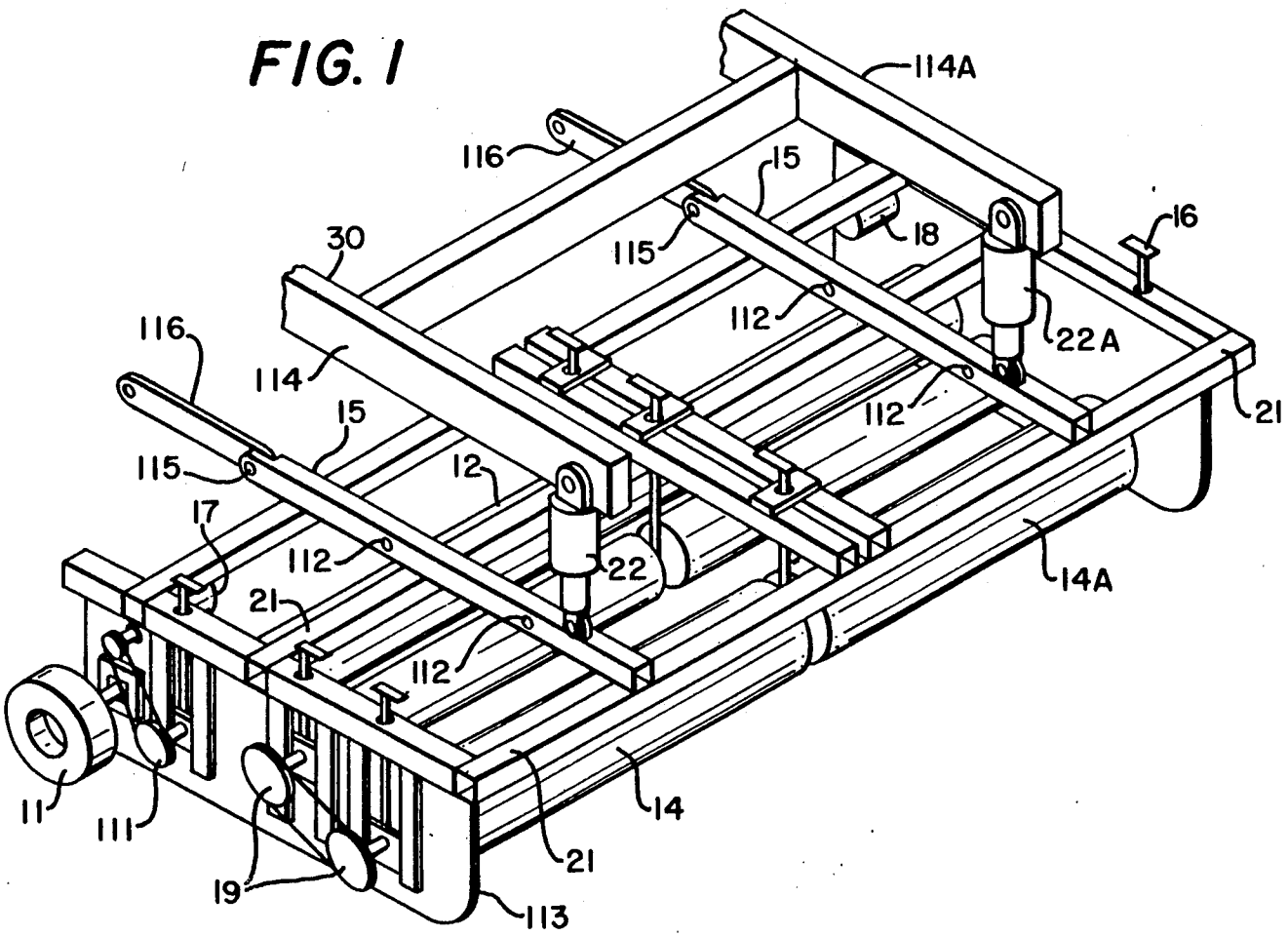
FIG. 1 is an isometric view of the "ROLLING SCREED" Spreader Box according to the present invention.

Referring now to FIG. 1, there is shown a "ROLLING SCREED" Spreader Box being pulled by a truck mixer tow vehicle 30. The truck mixer 30 thoroughly combines the cold emulsified asphalt with the cold aggregate and deposits the mixture immediately in front of the "ROLLING SCREED" Spreader Box. As the "ROLLING SCREED" Spreader Box is pulled forward, the hydraulic motors 17 and 18 turn the left and right side augers 12 and 12A, which contact the paving mixture and distribute the material laterally as desired. The left and right "ROLLING SCREEDS" 13 and 13A level off the paving mixture to the desired depth of spread. The compression rolls 14 and 14A then compact the paving material and the down pressure of the compression rolls 14 and 14A, cause the "ROLLING SCREED" 13 and 13A to turn at the same RPM as the compression rolls 14 and 14A, because they are connected by chain and sprocket 19. Pressure cylinders 22 and 22A are advantageously attached between the frame 114 of the travel mixer or towing vehicle to apply pressure on the compression rollers. With a front wheel drive towing vehicle 30, maximum pressure, such as with hydraulic cylinders, can be advantageously applied sufficient to lift the rear of the vehicle off of the ground. In certain situations it may be advantageous to adjustably apply the pressure to cylinders 22 and 22A so that the desired amount of roadway compaction is accomplished. The preferable towing connection arms 115 are pivotable front and back so that the pressure from the cylinders 22 is independent of the towing connection.

The "ROLLING SCREED" Spreader Box can be operated without the compression rolls 14 and 14A or with the compression rolls in the raised position. The paving mixture would then be compacted by conventional asphalt rollers. The "ROLLING SCREED" Spreader Box includes a pair of front wheels 11 (only one of which is shown in FIG. 1), a left side power means 17, connected by sprocket and drive chain to the left side auger sprocket 111 (right side sprocket and drive chain not shown), a left side auger 12 and a right side auger 12A for distributing the paving mixture laterally as necessary, left side sprocket and drive chain 19 connecting the left side "ROLLING SCREED" 13 and the left side compression roll 14 (right side sprockets and chain not shown).

Right side power means, drive motor 18, transfers power via chain and sprockets (not shown) to the right side auger 12A. The right side "ROLLING SCREED" 13A is connected by chain and sprocket (not shown) to the compression roll 14A, the connection by chain and sprocket between the left and right "ROLLING SCREED" 13 and 13A and left and right compression rolls 14 and 14A make the screed roll and compression roll turn at the same RPM, thereby eliminating any possibility of a build-up in front of screed roll and absolutely no "rock drags". A tow bar 15 is connected through pivot towing eyelet 115 to tow arm 116. A height and adjustment screw 16 (typical) is provided for adjusting the depth of spread, a left side plate 113 (typical of right side), frame or bridge 21. Hydraulic cylinders 22 and 22A are connected between vehicle frame members 114 and 114A and tow bar 15 to apply pressure downwardly for compaction. Advantageously, the cylinders 22 and 22A provided adjustable pressure up to a pressure capable of lifting the rear wheels of the travel mixer or towing vehicle up off of the ground.

Figure 2:
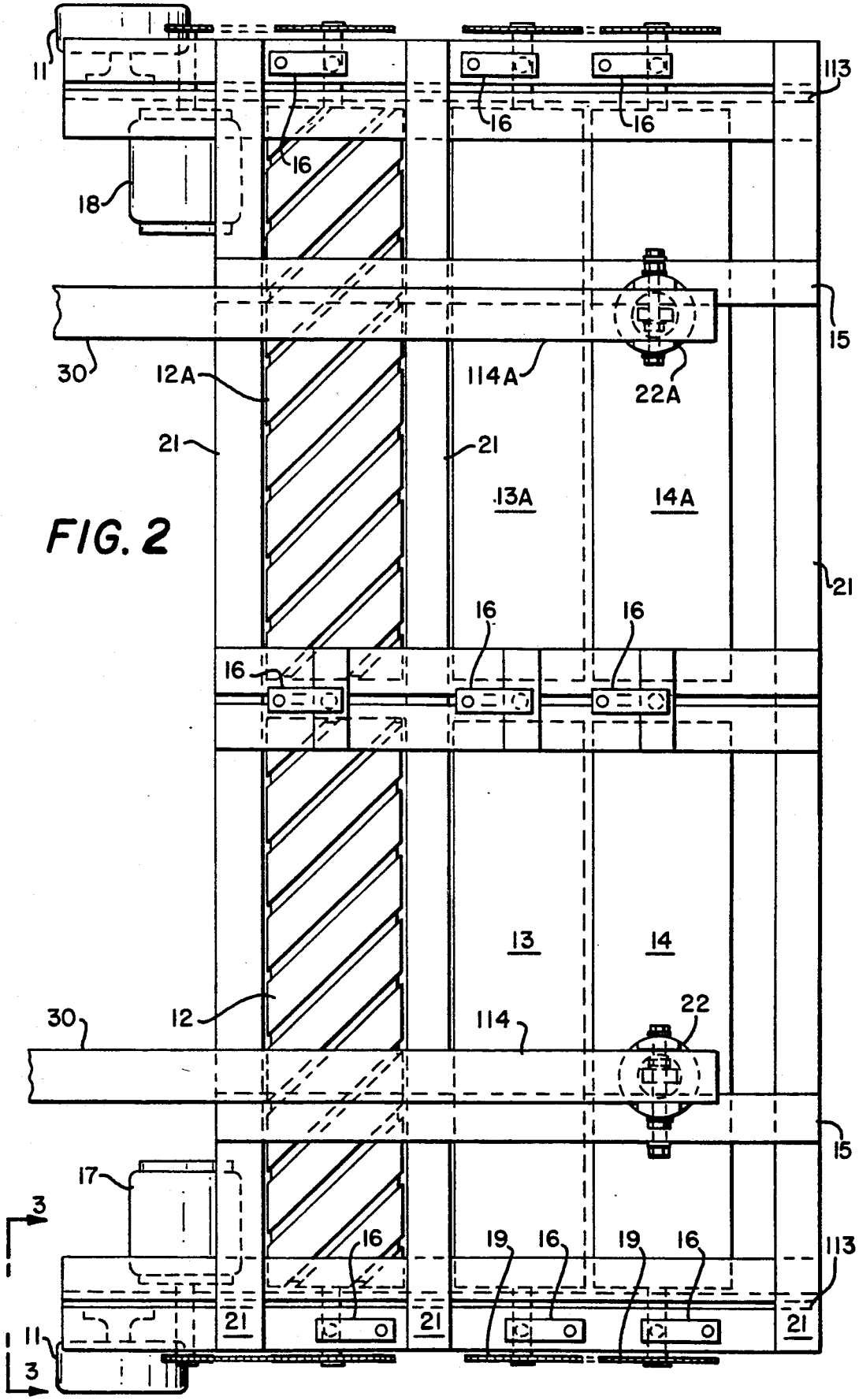
FIG. 2 is a top view showing the placement of the right and left hand distribution augers, right and left "ROLLING SCREED", right and left compression rollers, height adjustment screws, hydraulic motor, sprockets, drive chains, tow bar, and pressure cylinders.

Referring now to FIG. 2, shows a top view of the "ROLLING SCREED" Spreader Box. Left and right front wheels 11, left and right side power means drive motors 17 and 18 to power the left and right augers 12 and 12A, handles for height adjusting screws 16 (typical), towing bars 15, pivot eyelets 115, left and right side "ROLLING SCREED" 13 and 13A, left and right compression rolls 14 and 14A, left and right side plates 113 (typical), frame or bridge 21.

Figure 3:
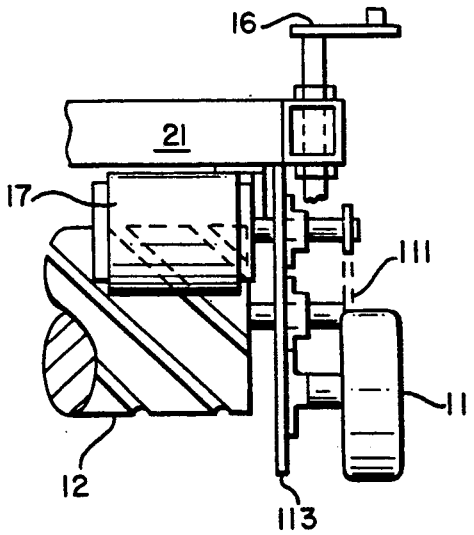
FIG. 3 shows a partial view of the distribution auger, power means, sprockets and chain to drive auger, front wheel and typical adjustment screw for auger, "ROLLING SCREED" and compression roll.

Referring now to FIG. 3, shows a detail of the left side hydraulic motor 17, the left side auger 12, drive sprockets and drive chains 111 to transfer power to the auger. Height adjustment screw 16 (typical), side plate 113 and front wheel 11, frame or bridge 21.

Figure 4:
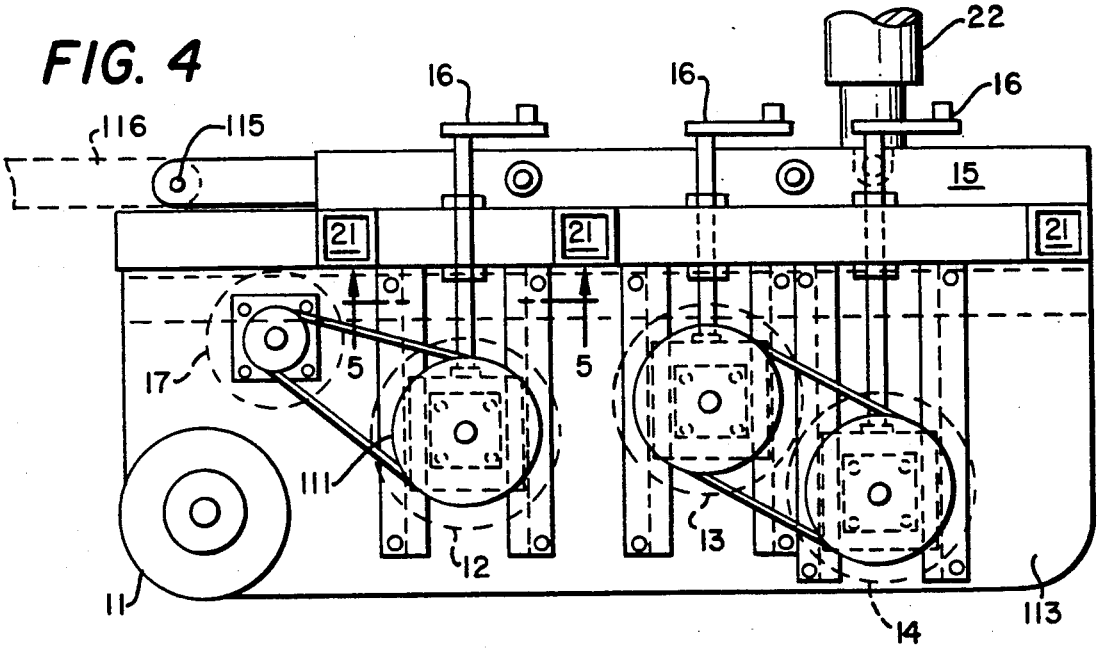
FIG. 4 is a side view showing the side plates, lifting and tow bar, power means, adjustable auger, adjustable "ROLLING SCREED", adjustable compression roller, drive sprockets, chains, front wheel and typical adjusting screws for setting the depth of spread.

Referring now to FIG. 4, shows a side view of the "ROLLING SCREED" Spreader Box, a left front wheel 11 (typical), a left side sprocket and chain drive system 111 to power the left side auger 12. A "ROLLING SCREED" 13, a left side compression roll 14, a left side plate 113, a left side lifting and tow bar 15, a pair of left side lifting eyelets 112 (typical), height adjustment screws for adjusting depth of spread 16 (typical), frame and bridge (21).

Figure 5:
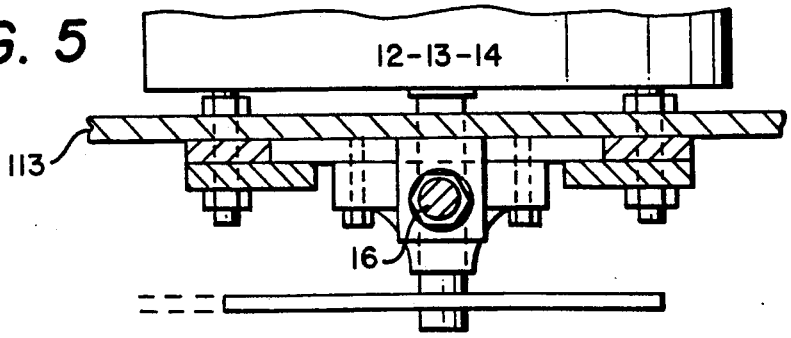
FIG. 5 shows a typical detail of the height adjustment apparatus for the auger. "ROLLING SCREED" and compression roller. It also shows the bearing holder sliding adjustment apparatus and adjustment screw for the height adjustment of auger. "ROLLING SCREED" and compression roller. It shows the side plate, frame and drive chain sprocket.

Referring now to FIG. 5, shows a typical detail of the adjusting device 16 and bearing holder for the auger 12, "ROLLING SCREED" 13, compression roll 14, drive sprocket 11 and side plate 113.

Figure 6:
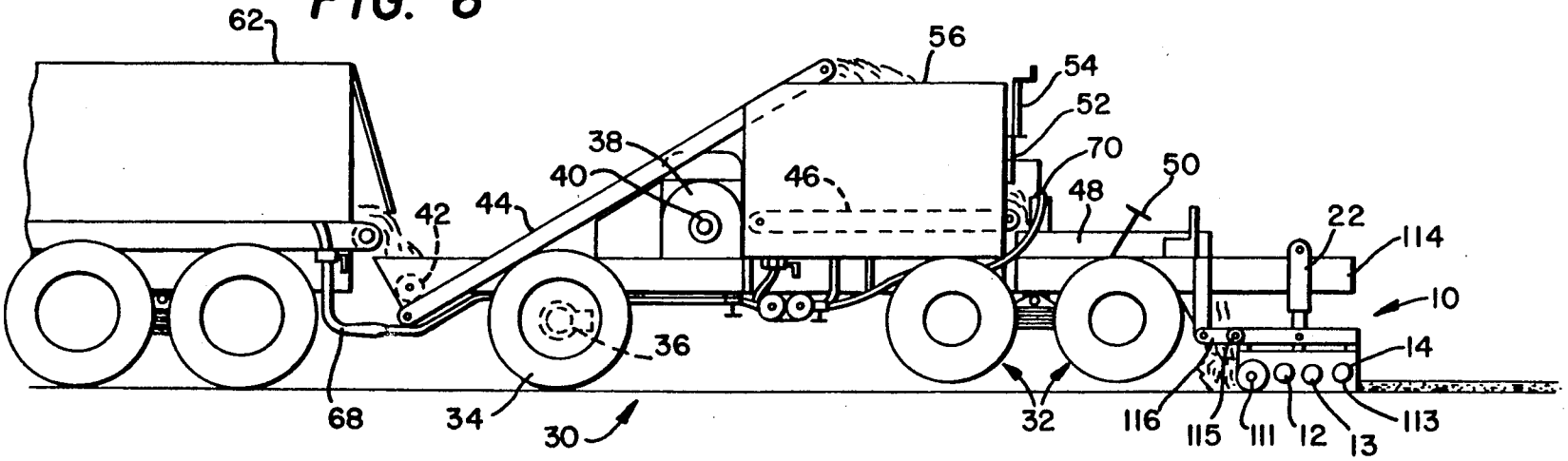
FIG. 6 shows a side view of a travel mixer and attached rolling screed spreader box, preceded by a cutaway portion of a conveyor trailer.

FIG. 6 shows a side view of a travel mixer 30 to which a "ROLLING SCREED" spreader box 10 is attached through a pivot arm 116 and also at rigid frame member 114 through a hydraulic cylinder 22. The hydraulic cylinder 22 is capable of applying sufficient pressure to raise rear wheels 32 off of the ground. The travel mixer 30 includes front wheel drive, front wheels 34, which may be driven with hydraulic motors 36 and maintained in contact with the road surface, even when maximum pressure is applied through cylinders 22. The travel mixer may be powered with a motor 38, such as a diesel engine 38, which may drive hydraulic pumps 40 to supply power to the various hydraulic motors used in the mixer including front wheel drive motors 36, hopper auger 42, input conveyor 44, output conveyor 46 and twin shaft mixer 48. The operator of the unit has controls at the rear of the travel mixer vehicle at 50, by which the vehicle can be steered the various aspects, including hydraulic pressure and cylinders 22 can be adjustably controlled. An output hopper gate 52 is also provided with an adjustment 54, so that the amount of aggregate mixture delivered to the twin mixer shafts 48 is properly adjusted.

Figure 7:
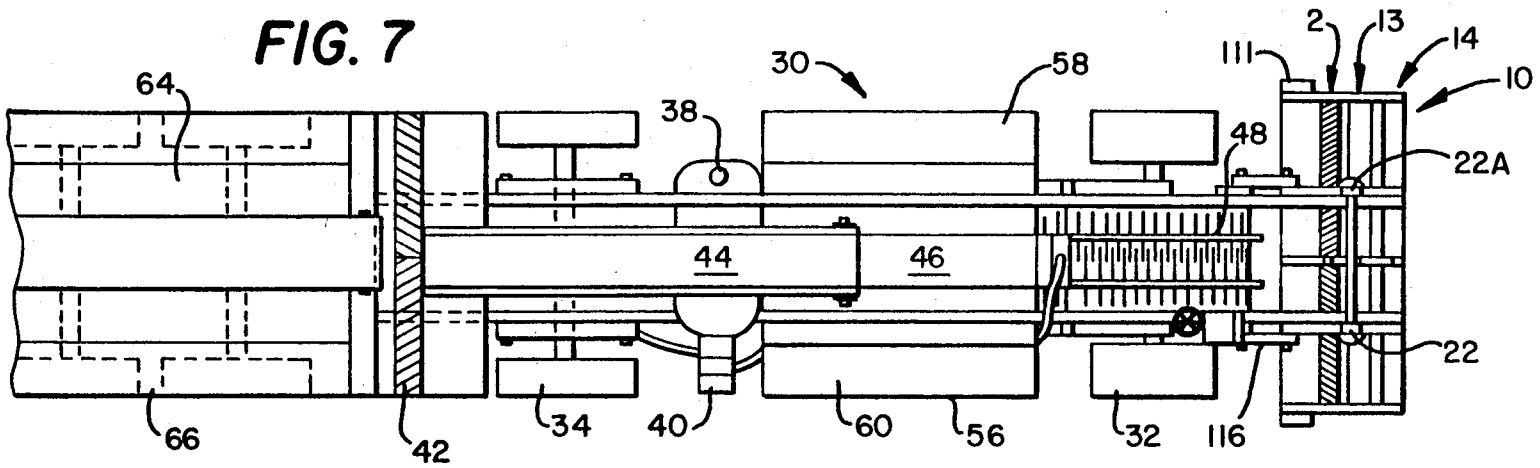
FIG. 7 is a top schematic view of the travel mixer and rolling screed spreader box and material conveyor trailer of FIG. 6.

With reference also to FIG. 7, the construction of the travel mixer 30 can further be understood, it being noted that the hopper 56 preferably includes V-shaped sides 58 and 60, by which the materials input by input conveyor 44 are funneled down to output conveyor 46. The conveyor trailer 62 is advantageously constructed with a V-hopper 64, with side tanks 66 for supplying asphalt through a conduit 68, which can be mixed with the rock, gravel or other aggregate mixture contained in hopper 64.

Figure 8:
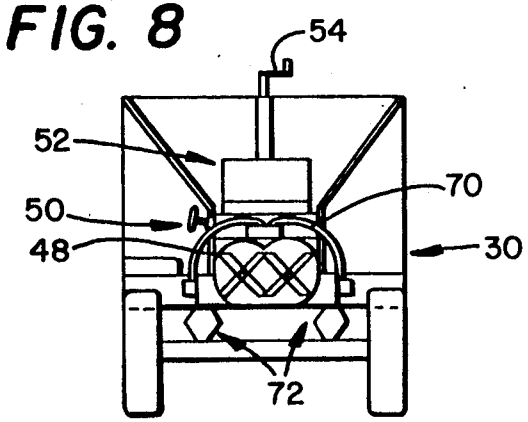
FIG. 8 is a rear view of the travel mixer of FIGS. 6 and 7.

With reference to FIG. 8, which is a rear view of a travel mixer 30, the construction and arrangement of the double shaft mixer 48, operator controls 50 and slide gate 52 with adjustment 54. There is an asphalt emulsion spray means 70 by which liquid asphalt emulsion may be added to the aggregate as it is being mixed with the double mixers 48. Suspension means such as air bags 72 may be applied to control the load of the travel mixer.

Figure 10:
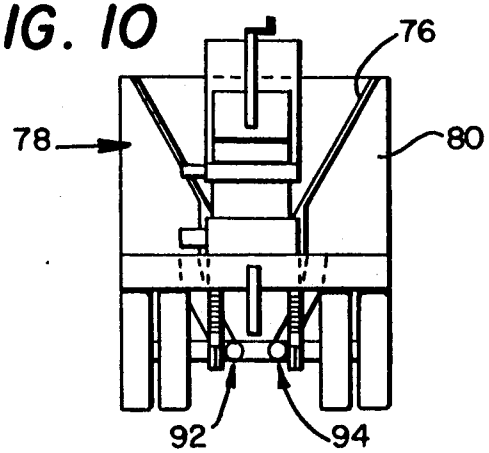
FIG. 10 is a rear view of a conveyor trailer for conveying Portland cement materials.
Figure 9:
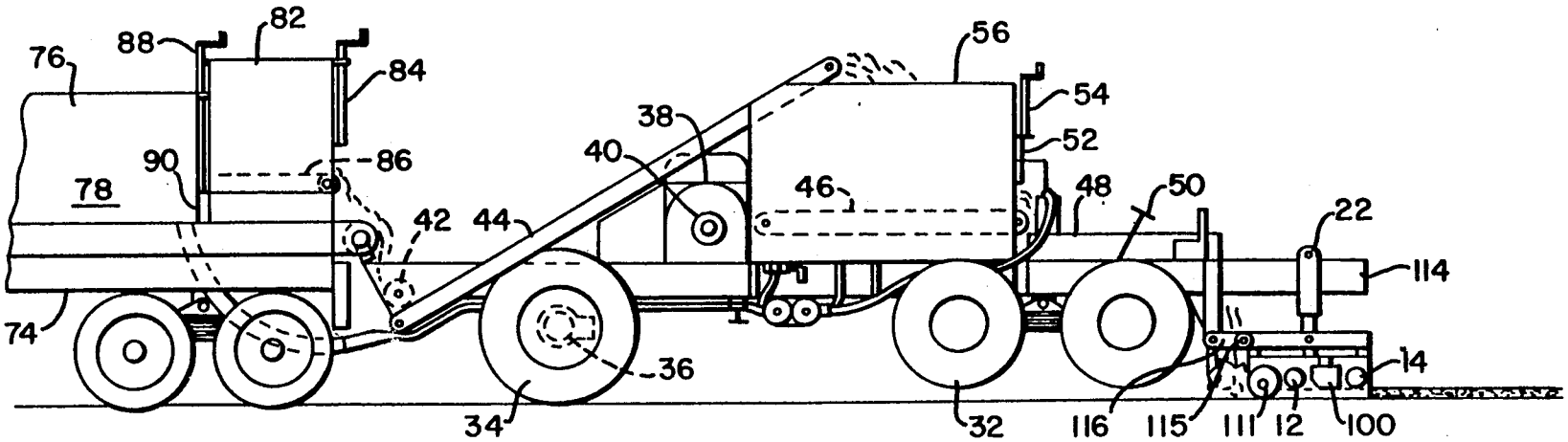
FIG. 9 is a schematic side plan view of a travel mixer and vibratory Portland cement concrete screed and compaction spreader box, preceded by a conveyor trailer for supplying materials for Portland cement to the travel mixer.

Referring to FIGS. 9 and 10, the conveyor trailer in the case of Portland concrete mixing and spreading and the modifications thereto can be understood. The travel conveyor trailer 74 has a V-hopper 76. V-hopper 76 would contain the rock or gravel for the concrete mixture. Side tank 78 could carry water or another liquid. The opposite side tank 80 could carry more water or alternatively it could carry an asphalt mixture so that both types of paving could be accomplished with a single trailer 74. There is a cement hopper 82 having an outlet gate 84 and a bottom conveyor 86, by which the cement is adjustably delivered from the conveyor trailer. An adjustable gate 88 is positioned in advance of V-hopper 76 to permit the rock or gravel mixture to be adjustably delivered along conveyor 90. Conduit 92 may be employed in conjunction with tank 78 to deliver water and another conduit 94 may be employed to convey the liquid in tank 80, whether it be water or asphalt, through two coupled conduits to the gravel mixer 30.

With reference to FIG. 9, which shows a side view of a travel mixer having a vibratory screed 100 attached thereto, followed by a compression roller 14, it will be noted that the vibratory screed 100 is in place of the "ROLLING SCREED" 13. While the "ROLLING SCREED" 13 has advantages with respect to cold asphaltic emulsions, the vibratory plate screed 100 has advantages in leveling a Portland concrete mixture for compaction. The inventive application of hydraulic pressure to the compaction roller immediately following the screed is advantageous regardless of the type of screed used. Adjustable pressure on the roller is advantageous if less pressure is required for the type of material to be compacted.

While the invention has been disclosed in connection with specific embodiments, it is not intended to be limited to the embodiments disclosed, but to the contrary, is intended to cover such variations and equivalents as fall within the scope of the following claims.

What is claimed is:

1. A spreading device for towing behind a traveling material mixer vehicle for applying a cold mixed paving material to a surface to be paved comprising:

(a) a frame of a width substantially equal to the width of said surface to be paved and having left and right sides:

(b) an auger rotationally attached to said frame spaced above and substantially parallel to said surface to be paved for distribution of said cold mix paving material in a layer across and along said surface to be paved;

(c) a rolling screed rotationally attached to said frame adjacent and substantially parallel to said auger means and spaced above said surface to be paved for spreading said cold mix paving material in a substantially flat layer across and along said surface to be paved;

(d) a compression roller attached for rotation to said frame adjacent to said rolling screed and substantially parallel thereto; and (e) a pressure cylinder attached between said towing vehicle and said spreader box for applying pressure downwardly on said compaction roller while lifting upwardly on said towing vehicle.

2. A spreading device as in claim 1 wherein the travel mixer is front wheel drive and said pressure cylinder comprises a pair of hydraulic cylinders capable of lifting the rear of the travel mixer off of the ground.

3. A spreading device as in claim 1 wherein the pressure in said pressure cylinder is adjustable.

4. A spreading device as in claim 1 further comprising:

(a) a height adjuster for said rolling screed; and (b) a height adjuster for said compression roller.

5. A spreading device as in claim 1 further comprising a power transmission means for interconnecting the rotation of said rolling screed with the rotation of said compression roller so that build up of paving material between said rolling screed and said compression roller is reduced and "rock drag" is avoided.

6. A spreading device as in claim 1 further comprising:

(a) a first applicator attached to said frame for applying releasing agent to said rolling screed; and (b) a second applicator attached to said frame for applying releasing agent to said compression roller.

7. A spreading device as in claim 1 wherein said auger further comprises:

(a) a left side auger independently powered for selectable rotation for moving cold mix toward the left or toward the middle of said frame; and (b) a right side auger axially aligned with said left side auger and independently powered for selectable rotation for moving cold mix toward the right or toward the middle such that said selectable powering of said augers can be used to distribute cold mix material in a substantially even layer across said frame width.

8. A spreading device as in claim 7 further comprising a height adjuster for said right and left augers.

9. A spreading device for applying a paving material behind a towing vehicle, comprising:

(a) a fixed or extendable frame spread box;

(b) an adjustable vibratory plate screed for screeding or spreading the paving material to a desired depth of spread of said paving material;

(c) an adjustable compression roller for compacting the paving material;

(d) conveyance means on each side of said spreader box;

(e) adjusters on said screed and said compression roller to adjust the depth of spread of said paving material; and (f) a pressure cylinder attached between said towing vehicle and said spreader box for applying pressure downwardly on said compaction roller while lifting upwardly on said towing vehicle.

10. A spreading device for towing behind a traveling material mixer vehicle for applying a Portland cement concrete paving material to a surface to be paved comprising:

(a) a frame of a width substantially equal to the width of said surface to be paved and having let and right sides;

(b) an auger device rotationally attached to said frame spaced above and substantially parallel to said surface to be paved for distribution of said paving material in a layer across and along said surface to be paved;

(c) a vibratory plate screed attached to said frame adjacent and substantially parallel to said auger means and spaced above said surface to be paved for spreading said paving material in a substantially flat layer across and along said surface to be paved;

(d) a compression roller attached to said frame for rotation adjacent to said vibratory screed and substantially parallel thereto; and (e) a pressure cylinder attached between said towing vehicle said spreader box for applying pressure downwardly on said compaction roller while lifting upwardly on said towing vehicle.

11. A spreading device as in claim 10 wherein the travel mixer is front wheel drive and said pressure cylinder comprises a pair of hydraulic cylinders capable of lifting the rear of the travel mixer off of the ground.

12. A spreading device as in claim 10 wherein the pressure in said pressure cylinder is adjustable.

13. A spreading device as in claim 10 further comprising:

(a) a height adjuster for said vibratory plate screed; and (b) a height adjuster for said compression roller.

14. A spreading device as in claim 10 wherein said auger device further comprises:

(a) a left side auger independently powered for selectable rotation for moving paving material toward the left or toward the middle of said frame; and (b) a right side auger axially aligned with said left side auger and independently powered for selectable rotation for moving paving material toward the right or toward the middle such that said selectable powering of said augers can be used to distribute cold mix material in a substantially even layer across said frame width.

15. A spreading device as in claim 14 further comprising a height adjuster for said right and left augers.

16. A machine for applying mixture of paving materials to a roadway surface comprising:

(a) a movable conveyor trailer having separate compartments for holding each component of the mixture and for conveying such component materials in adjustable proportions out of the trailer while it is moving for mixing thereof:

(b) a travel mixer for receiving and mixing the components of the paving mixture from the conveyor trailer and for delivery of the mixture to the roadway surface to be paved while moving, and having rigid frame members projecting behind the mixer;

(c) a screed and roller compactor spreader box attached behind the travel mixer for screeding the delivered paving mixture over the roadway and for compacting the mixture after it is spread; and (d) pressure cylinders operatively connected between the rigid frame members of the travel mixer and the spreader box for applying sufficient force downward from the travel mixer to the spreader box roller compactor for final compaction of the paving mixture on to the roadway for use as a traffic bearing surface.

* * * * *